US006438863B1

(12) United States Patent
Jensen

(10) Patent No.: US 6,438,863 B1
(45) Date of Patent: Aug. 27, 2002

(54) APPARATUS FOR THE DRYING OF MOIST PARTICULATE MATERIAL IN SUPERHEATED STEAM

(75) Inventor: Arne Sloth Jensen, Lyngby (DK)

(73) Assignee: ASJ Holding ApS, Lyngby (DK)

( * ) Notice: Subject to any disclaimer, the term of this patent is extended or adjusted under 35 U.S.C. 154(b) by 0 days.

(21) Appl. No.: 09/647,264

(22) PCT Filed: Mar. 31, 1999

(86) PCT No.: PCT/DK99/00196

§ 371 (c)(1),
(2), (4) Date: Sep. 27, 2000

(87) PCT Pub. No.: WO99/51924

PCT Pub. Date: Oct. 14, 1999

(30) Foreign Application Priority Data

Apr. 6, 1998 (DK) ..... 1998 00488
Feb. 23, 1999 (DK) ..... 1999 00241

(51) Int. Cl.[7] ..... F26B 17/12
(52) U.S. Cl. ..... 34/168
(58) Field of Search ..... 34/168, 165, 169, 34/455

(56) References Cited

U.S. PATENT DOCUMENTS 3,646,688 A * 3/1972 Osterman ..... 34/168
4,057,909 A * 11/1977 Paterson et al. ..... 34/76
4,114,289 A * 9/1978 Boulet ..... 34/173
4,197,660 A * 4/1980 Breitschaft et al. ..... 34/166
4,458,428 A * 7/1984 Saeman ..... 34/506
4,499,669 A * 2/1985 Haeck ..... 34/102
4,746,404 A * 5/1988 Laakso ..... 162/232
4,813,155 A 3/1989 Jensen et al. ..... 34/455
5,289,643 A 3/1994 Jensen ..... 34/169
5,357,686 A 10/1994 Jensen ..... 34/169
6,249,989 B1 * 6/2001 Conochie et al. ..... 34/337

OTHER PUBLICATIONS

"Pressurized Steam Drying of Beet Pulp" by Arne Sloth Jensen, NIRO A/S Special print of article in International Sugar Journal, Nov. 1992.

* cited by examiner

*Primary Examiner*—Teresa Walberg
*Assistant Examiner*—Daniel Robinson
(74) *Attorney, Agent, or Firm*—William J. Sapone; Coleman Sudol Sapone, P.C.

(57) ABSTRACT

An apparatus for drying particulate materials in superheated steam in a closed container has a cyclone for separating dust from the steam, the cyclone located in an upper part thereof. The cyclone has openings for receiving at least part of the dust laden steam located in an upper part thereof so that large, moist particles are separated and led back to the processing cells before the steam enters the cyclone.

10 Claims, 2 Drawing Sheets

APPARATUS FOR THE DRYING OF MOIST PARTICULATE MATERIAL IN SUPERHEATED STEAM

Figure 1:
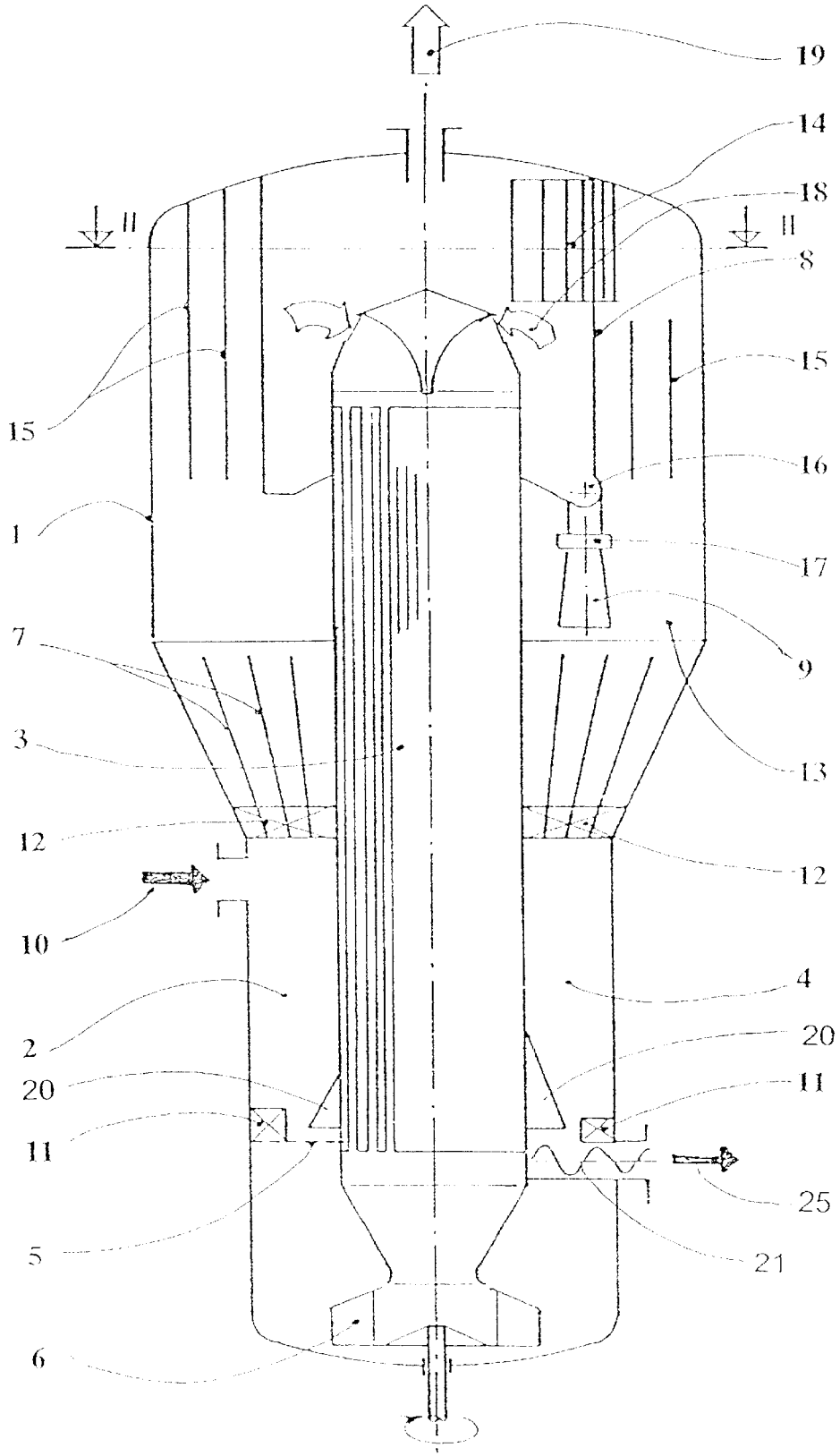

The invention concerns an apparatus for the drying of particulate materials in superheated steam in a closed container which is configured as a revolution element. The container has a lower cylindrical part which via a conical transition piece is connected to an upper cylindrical part with a greater diameter. In a centre part of the container there is a heat exchanger, and below this an element for the transport of steam, e.g. in the form of a blower such as a centrifugal blower. The container comprises a series of upwardly-open, elongated and substantially vertical processing cells which are disposed around the central part with the heat exchanger. The last of these processing cells has a closed bottom and is the discharge cell, while the remainder have a bottom through which steam can permeate. The processing cells, which lie at the side of one another, are open at the top opposite a common transfer zone, and at the bottom stand in mutual connection through openings at the lower ends of the cells. The particle-formed material is led into the first of the processing cells, and is dried during its passage through the processing cells by the superheated steam which by the steam transport element is blown up from the heat exchanger through the permeable bottom of the cells, in that the particle-formed material can pass from one processing cell to the next through said openings. The upper cylindrical part also contains a dust separation system in the form of a cyclone for the cleaning of the steam before this is transported further.

The material to be dried is led into the first of the processing cells where it is brought into a swirling movement by the steam which flows up through the steam-permeable bottom of the cell. The heaviest particles pass from the one processing cell to the next through openings at the bottom. The lighter particles are blown up into the conical part, which is similarly divided into cells. Moreover, these cells are divided by inclined plates which form conical surfaces. Opposite the lowermost parts of the conical surfaces there are openings between the processing cells to which material is led by guide rails placed on the conical surfaces. Above the cells there is a common zone where material is also fed forwards towards the discharge cell. Unlike the remaining cells, steam does not flow up through the bottom of the discharge cell. Consequently, all of the product which reaches this cell falls down to the bottom, from where it is led away.

An apparatus of this type is known, for example from DK patent publication no. 156 974, EP patent publication no. 537 262 and EP patent publication no. 537 263.

The use of the apparatus for the drying of sugar beet pulp is discussed in an article by Arne Sloth Jensen in International Sugar Journal, November 1992, Vol. 94, No. 1127. The dried beet pulp is normally used as cattle feed. It is precisely within the sugar industry that the apparatus finds particular application. In this as well as in other industries, the apparatus enables the drying to take place without oxidising the product and without any influence on the environment, in that the drying is effected in a closed container, in this case under pressure. Consequently, nothing escapes to the atmosphere, unlike the conventional drum-type dryers, which can be smelled approx. 20 km away. The water which is removed from the moist product leaves the drier as steam. This steam contains all of the energy which is used for the drying, and it can be used in the factory as processing steam. A normal sugar factory hereby saves between 50 and 120 tons of fuel oil per day, or a corresponding amount of other fuel. Moreover, the process makes it possible for a sugar factory to keep the whole of the production running with bio-fuel by burning the dried waste from the process, this waste in dried form containing more energy than the sugar factory requires. In such a case, the saving in the amount of fuel is approx. three times greater.

The known apparatus can also be used for the drying of wood-chips or other moist fuels, whereby the overall energy savings are increased.

It is desirable, however, for the capacity of the apparatus to be increased, so that the capacity is increased in proportion to the cost of the apparatus, in that the relatively high price of the known apparatus in relation to its capacity is the most significant disadvantage of the known apparatus.

With the known apparatus, the capacity is more or less proportional to the circulating flow of steam. With the hitherto known configuration of the apparatus, where the supply of steam to the cyclone takes place at the bottom of the cyclone, the flow can not be increased without this at the same time resulting in an unacceptable great amount of particle-formed material being swept up with the steam into the dust-separation cyclone. From here, it will pass out of the apparatus without having been adequately dried, and thus the quality of the product discharged is reduced.

It is thus the object of the invention to provide an apparatus which has a greater drying capacity than the known types of apparatus, without this giving rise to an increase in the cost of the apparatus, and without any reduction in the quality of the finished product.

This object is achieved in that at least a larger part of the steam supply from the common transfer zone to the cyclone is effected in an upper part of the cyclone.

The apparatus can hereby operate with a greater circulating flow of steam, in that the large volume in the container around the dust-separation cyclone is involved in the separation. This is effected by not feeding the steam, or only to a small extent, into the bottom of the cyclone, which has hitherto been the practice, but by feeding at least a larger part of the steam, i.e. at least a half part, into the upper part of the cyclone. It has thus proved, surprisingly, that the supply of steam to the bottom of the cyclone can be closed without this giving rise to a blockage. With the apparatus according to the invention, the moist product material which is carried out of the top of the processing cells, and especially the first of the processing cells, will not reach the cyclone. Instead, and as a result of the centrifugal force which arises when the particles are carried around with the flow of steam in the uppermost part of the container around the cyclone and forward towards the cyclone's steam supply, these particles will hit the outer wall of the container. Here they will form a layer which will slide downwards and back to the processing cells. It will thus only be dried dust which is carried with the steam flow into the cyclone.

It has thus shown with the invention that the steam flow can be increased to such a degree that the capacity of the apparatus is increased by 20–25% without an increase in the cost of the apparatus, and without any reduction in the quality of the finished product.

With a suitable configuration, the supply of steam from the common transfer zone to the cyclone can take place in an area which lies substantially directly above the last cells, i.e. the last processing cells and the discharge cell. It is hereby further ensured that moist particles carried from the processing cells and especially from the first processing cells will not be able to pass directly into the cyclone, but will be driven around this so that a separation of these particles takes place.

A smaller part of the steam flow, i.e. less than a half part, can be supplied to the lower part of the cyclone, but it can also be chosen to let the whole of the steam supply take place in the upper part of the cyclone.

The separation of particles, which is effected in the volume around the cyclone, can be reinforced by suspending cylindrical or spiral plates down from the top of the container, so that the plates are disposed wholly or partly around between these concentric or spiral plates forwards towards the cyclone, a layer of particles will be formed on the inner sides of the plates, and this will slide down and back to the precessing cells.

It can be expedient for openings to be formed in the cylindrical plates, so that the steam can flow forward to the steam supply opening in the cyclone.

It can be expedient for the bottom of the cyclone to be configured with a discharge opening for the separated dust, and this discharge opening can also be connected with a pipe, said pipe leading the separated dust down into the discharge cell, from where the dust is led out together with the remaining dried product material.

Figure 2:
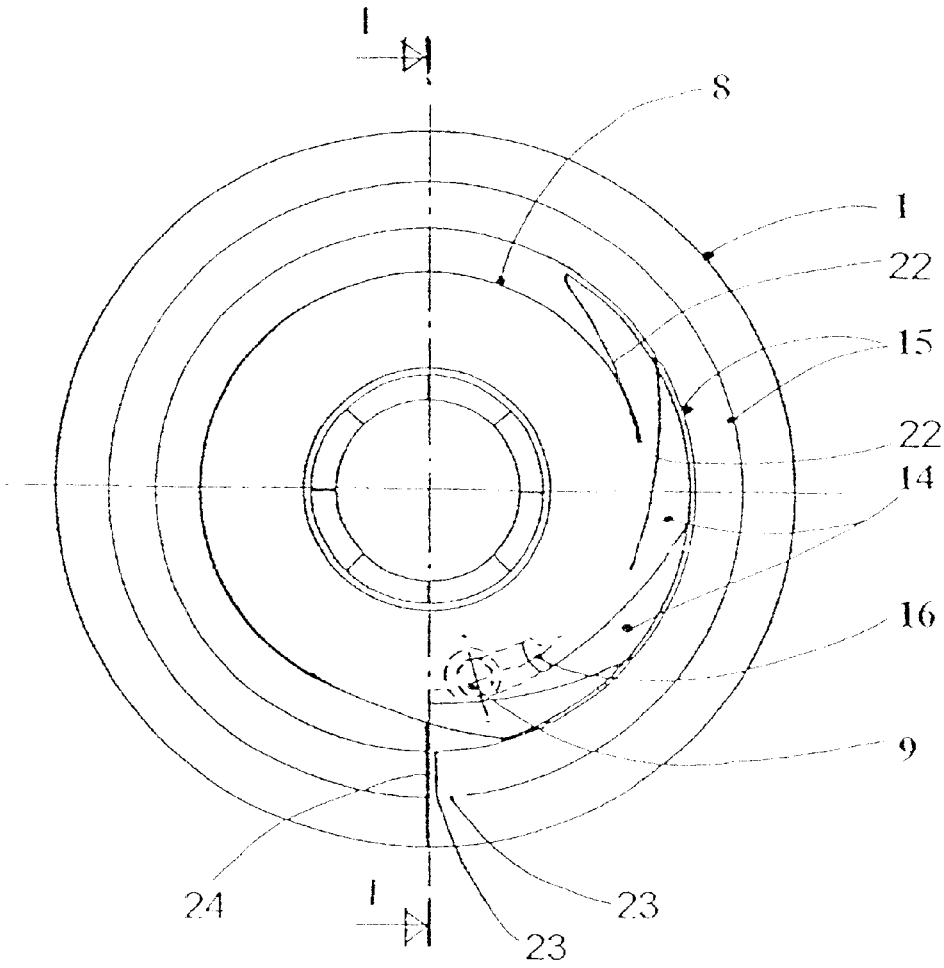

The invention will now be described in more detail with reference to the drawing, where FIG. 1 shows a vertical section of an apparatus according to the invention, said section having been taken along the line I—I in FIG. 2, and FIG. 2 shows a horizontal section through the uppermost part of the apparatus, said section having been taken along the line II—II in FIG. 1.

FIG. 1 shows a section of an apparatus for the drying of moist material in particle form, where said material can have particles which are non-uniform in size. The apparatus comprises a cylindrical container 1 which can be a pressure vessel, in that the process can with advantage be effected under pressure. Lowermost, the container has a cylindrical part which is closed at the bottom, and which via a transition piece extends over into a similarly cylindrical part which is closed at the top. In the lowermost part and the conical transition piece there are a series of elongated, substantially vertical process zones which are also called cells or processing cells 2. These processing cells 2, of which e.g. there can be sixteen inside the container 1, are disposed around a heat exchanger 3 which is placed in the centre of the container 1.

During the drying process, the particle-formed material, which especially can consist of particles of different sizes, is transported forward through the processing cells 2, in that the material is fed in to the first processing cell 2 and is removed from the last processing cell, also called the discharge cell 4. With the exception of the discharge cell 4, all of the processing zones 2 have a bottom 5 through which steam can permeate while the bottom in the discharge cell 4 is closed or not steam-permeable. The drying of the particle-formed material takes place thus in all of the processing cells 2 except for the discharge cell 4, in that superheated steam will be transported by a blower in the form of a centrifugal blower wheel 6 placed under the heat exchanger 3 up through the steam-permeable bottoms 5 into the processing cells 2. Here, the steam will bring the particle-formed material into a swirling movement, whereby a drying of the particles is effected.

As mentioned, the container 1 is divided into cells in both the lowermost part and the conical transition piece, while the container in the uppermost part constitutes a common zone 13 which is not divided into cells. In the cells 2 in the transition piece there are inserted conical plate pieces 7 which can be heated. In addition to the distribution of the steam flow through the cells 2 over to the common zone 13, these conical plate pieces serve to intercept the steam-driven particles and lead these downwards again.

In the uppermost part of the apparatus there is also a cyclone 8 which serves to separate dust particles which are swept along with the steam flow. The cyclone comprises a cylindrical container part with a bottom part which is substantially closed. The supply of steam to the cyclone takes place through openings 14, such as shown in FIG. 2, said openings 14 being formed by placing a number of vanes 22 (in the shown example, four vanes) at the inlet to the cyclone. The steam will flow into the cyclone between these vanes 22, so that a cyclone field is created. As shown in FIGS. 1 and 2, the openings 14 are placed in the upper part of the cyclone and in that part of the cyclone which lies in the area immediately above the last processing cells 2 and the discharge cell 4, i.e. above the processing cells which lie furthest away from those processing cells in which most of the moist material is processed.

A number of cylindrical plates 15 are suspended in the container in the area around the cyclone. These plates serve to guide the steam when this flows towards the cyclone 8, and apart from the area opposite the openings 14 in to the cyclone 8, they reach right up to the top of the container 1. As will be seen in FIG. 1, here there is a distance to the top of the container 1, so that openings 23 are formed as shown in FIG. 2 through which the steam can flow into the cyclone 8. As will also be seen from FIG. 2, a stop-plate 24 can be disposed in a radial manner between the cyclone 8 and the outer wall of the container 1, so that the steam currents cannot continue around the cyclone 8, but are turned in towards the cyclone's openings 14.

Instead of the configuration of the plates 15 as concentrically arranged cylinder surfaces as shown in FIG. 2, the plates in the area around the cyclone can be configured as parts of a spiral or with a helical form. These plates can be arranged in such a manner that a wholly or partly helical passage is formed for the steam forward to the openings 14 in the cyclone 8. In this connection, helical is to be understood as meaning that the passage in the direction of the steam flow has an essentially decreasing distance to the cyclone.

As shown in FIG. 1, the cyclone has a closed bottom in which, however, a discharge opening 16 is provided for separated dust. This discharge opening 16, which is also shown with stippled lines in FIG. 2, is connected to a pipe 9 which leads down to the processing cells and particularly to the discharge cell 4. The pipe 9, which as shown in FIG. 1 has an outlet cone, is further provided with an annular ejector 17 which is driven by power steam, and which serves to overcome the difference in pressure between the inside of the cyclone and the discharge cell 4.

In the following, the function of the apparatus as well as the individual parts of the apparatus will be described in more detail.

The moist particulate material is fed to the apparatus in a continuous manner through an opening in to the first processing cell 2, such as shown by the arrow 10. In the processing cells 2, the particle-formed product is brought into a swirling movement by the upwardly-flowing superheated steam, which is blown up through the steam-permeable bottoms 5 by the centrifugal blower wheel 6. The swirling movement of the particle-formed material is supported by elements 20 with a triangular cross-section, said elements 20 being disposed at the bottom of the processing cells in towards the center of the apparatus. The circulating steam imparts heat to the particle-formed material, whereby water (and/or other liquid) is evaporated. The particle-formed material passes through openings 11 in the walls between and in the bottom of the processing cells 2 from the one cell to the next, and the material can similarly pass from the one cell to the next through openings 12 in the cell walls, said openings 12 being disposed at the lowermost part of the conical transition piece, such as shown in FIG. 1. Moreover, the particle-formed material can be carried by the steam up into the common zone 13, where it can pass further and fall down into a subsequent processing cell 2.

The steam will pass up out of the cells at a speed which causes particles to be carried with it, especially dust particles, but because of the relatively high speed of the steam, also larger particles which have not been sufficiently dried. The steam is fed to the cyclone 8 through openings 14, which as mentioned are preferably placed above the last processing cells 2 in the apparatus. Consequently, the steam which rises up from the first processing cells, in which in particular there can be moist particles, is forced to pass around the cyclone 8 and up between this and the outer wall of the container 1 in order to reach to the openings 14. On its way around the cyclone 8, the steam will pass between the concentrically suspended, cylindrical or helical plates 15, or between one of these plates 15 and either the outer wall of the cyclone or the outer wall of the container 1. Because of the centrifugal force, the largest (and heaviest) particles will be conveyed outwards and will hit the plates 15 or the outer wall of the container 1, where the particles will form a layer which will slide back to the processing cells 2. The consequence of this separation of the coarsest particles before the cyclone 8 is that more steam can be circulated in the drier, without too many moist particles being carried into the cyclone.

The particles of dust which reach inside the cyclone will be separated in the normal manner, in that a cyclone field is created by means of the vanes 22. The separated dust particles will circulate in the bottom of the cyclone 8 until they reach the discharge opening 16. From here, they are led via the pipe 9 down into the discharge cell 4 by means of an annular ejector 17 which is driven by power steam, so that the dust particles and a part-flow of steam are sucked down into the pipe's outlet cone.

As shown by the arrows 18, most of the steam from the cyclone will pass through openings down in the heat exchanger 3, in that the steam is sucked down through the openings by the fan or the centrifugal blower 6. After the steam has again been heated in the heat exchanger, it will be returned to the processing cells 2. A smaller part of the steam, corresponding to the amount of water which evaporates from the particle-formed material, will be led out from the top of the cyclone 8 through an opening as shown by the arrow 19. This steam contains all of the energy which is used for the drying, and since it is completely or almost free of dust and air and under pressure it can be used, for example, as process steam, or the energy can be regained in another manner. With the process there can hereby be achieved an almost 100% recovery, so that on the whole the drying becomes neutral from the point of view of energy consumption.

During the drying process in the apparatus, the particles will as described pass through the openings 11 and 12 in the cell walls into the discharge cell 4, and dried particles via the common zone 13 and dried dust particles via the cyclone 8 will as described also be led to the discharge cell 4. As shown in FIG. 1, in this there is placed a worm conveyor 21 which leads the dried, particle-formed material out of the apparatus as shown by the arrow 25.

What is claimed is:

1. An apparatus for drying particulate material in superheated steam comprising:

a closed container having a lower cylindrical part connected to a conical transition piece, the conical transition piece connected to an upper cylindrical part having a greater diameter than the lower cylindrical part;

a heat exchanger located in a central part of the container;

a steam transport element for receiving superheated steam from the heat exchanger, located in the lower cylindrical part and for transporting the superheated steam into the container through a steam permeable bottom;

a series of upwardly open, elongated and substantially vertical processing cells disposed around the central part with the heat exchanger, a first group of the processing cells being open at a top thereof opposite a common transfer zone and being open at a lower end thereof adjacent the steam permeable bottom, a second group of processing cells being open at a top thereof opposite the common transfer zone and being closed at a lower end thereof to form a discharge cell;

a dust separation cyclone located in the upper cylindrical part for receiving steam and dust and for separating the dust from the steam, the dust separating cyclone having openings at an upper part thereof for receiving at least part of the steam and dust therefrom.

2. The apparatus of claim 1 wherein the openings for the dust separating cyclone are located substantially in an area above the second group of processing cells.

3. The apparatus of claim 1 wherein the dust separating cyclone receives part of the steam and dust at a lower part thereof.

4. The apparatus of claim 1 wherein the dust separating cyclone receives all of the steam and dust at the upper part thereof.

5. The apparatus of claim 1 further comprising plates placed between the dust separating cyclone and a wall of the closed container, the plates being of a cylindrical configuration and placed concentrically.

6. The apparatus of claim 1 further comprising plates placed between the dust separating cyclone and a wall of the closed container, the plates having a helical or approximately helical configuration, and extending wholly or partly around the cyclone.

7. The apparatus of claim 5 wherein openings are provided in the plates for steam to flow through.

8. The apparatus of claim 6 wherein openings are provided in the plates for steam to flow through.

9. The apparatus of claim 1 further comprising a dust discharge opening located in a bottom part of the dust separating cyclone.

10. The apparatus of claim 9 further comprising a pipe connected with the discharge opening, and extending to the discharge cell to discharge dust thereto.

* * * * *